United States Patent [19]

Glanz

[11] Patent Number: 4,535,347

[45] Date of Patent: Aug. 13, 1985

[54] THERMALLY-RESPONSIVE RECORD MATERIAL

[75] Inventor: Kenneth D. Glanz, Appleton, Wis.

[73] Assignee: Appleton Papers Inc., Appleton, Wis.

[21] Appl. No.: 607,558

[22] Filed: May 7, 1984

[51] Int. Cl.[3] ..... B41M 5/18

[52] U.S. Cl. ..... 346/208; 346/209; 346/216; 346/217; 346/225; 427/150; 427/151

[58] Field of Search ..... 346/208, 209, 214, 216, 346/217, 221, 225; 427/150, 151, 152

[56] References Cited

FOREIGN PATENT DOCUMENTS 0126693 8/1982 Japan ..... 346/209
0137186 8/1982 Japan ..... 346/209

*Primary Examiner*—Bruce H. Hess
*Attorney, Agent, or Firm*—E. Frank McKinney; Paul S. Phillips, Jr.

[57] ABSTRACT

A thermally-sensitive color-forming composition is disclosed which comprises chromogenic material, acidic developer material and a hydroxyanilide compound. Record material comprising this color-forming composition exhibits an absence of image bloom and improved color-forming efficiency and/or image density.

11 Claims, No Drawings

THERMALLY-RESPONSIVE RECORD MATERIAL

This invention relates to thermally-responsive record material. It more particularly relates to such record material in the form of sheets coated with color-forming systems comprising chromogenic material and acidic color developer material. This invention particularly concerns a thermally-responsive record material with improved color-forming efficiency and/or image density.

Thermally-responsive record material systems are well known in the art and are described in many patents, for example U.S. Pat. Nos. 3,539,375; 3,674,535; 3,746,675; 4,151,748; 4,181,771; and 4,246,318 which are hereby incorporated by reference. In these systems, basic chromogenic material and acidic color developer material are contained in a coating on a substrate which, when heated to a suitable temperature, melts or softens to permit said materials to react, thereby producing a colored mark.

Japanese Patent Disclosure No. 57-137186 discloses a heat-sensitive recording material containing a leuco dye, an acid material and methoxyacetanilide or ethoxyacetanilide.

In the field of thermally-responsive record material, thermal response is defined as the temperature at which a thermally-responsive record material produces a colored image of sufficient intensity (density). The desired temperature of imaging varies with the type of application of the thermally-responsive product and the equipment in which the imaging is to be performed. The ability to shift the temperature at which a satisfactorily intense thermal image is produced for any given combination of chromogenic material and developer material is a much sought after and very valuable feature.

Also in the field of thermally-responsive record material, the ability to increase the efficiency of the thermal image formation process has decided advantages. Principal among these are the ability to obtain the same image density with a lower amount of reactants or, alternatively, to obtain a more intense image with the same amount of reactants.

Additionally, thermally-responsive record material, possessing desirable imaging features as described hereinabove, should not possess any detracting features such as the development of crystallization on the surface of the thermally-produced image, also called image bloom.

It is an object of the present invention to provide a thermally-responsive recording material having enhanced image intensity.

It is also an object of the present invention to provide a thermally-responsive recording material having an improved thermal response.

It is likewise an object of the present invention to provide a thermally-responsive record material having an absence of image bloom. Image bloom is a condition of certain thermally-responsive record material systems in which, after a thermally-produced image is formed, crystals are formed on the surface of the image merely upon normal storage of the imaged material. The resulting crystals detract from the appearance of the imaged material and image bloom is a recognized problem in the thermally-responsive record material art.

It is another object of the present invention to provide a thermally-responsive record material comprising a support member bearing a thermally-sensitive color-forming composition comprising chromogenic material and acidic developer material in contiguous relationship, whereby the melting or sublimation of either material produces a change in color by reaction between the two, a hydroxyanilide compound, and a suitable binder therefor.

It is yet another object of the present invention to provide a thermally-responsive record material comprising a support member bearing a thermally-sensitive color-forming composition comprising chromogenic material and acidic developer material in contiguous relationship, whereby the melting or sublimation of either material produces a change in color by reaction between the two, one or more hydroxyanilide compounds represented by the formula:

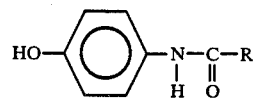

wherein in R represents a straight or branched alkyl group of not more than 17 carbon atoms, and a suitable binder therefor.

In accordance with the present invention, it has been found that these and other objectives may be attained by employing a thermally-sensitive color-forming composition comprising chromogenic material and acidic developer material, one or more hydroxyanilide compounds and binder material. The surprising feature of this composition is that, even though the hydroxyanilide compounds does not, by itself, function to a significant degree as a developer material, its inclusion with prior art thermally-sensitive color-forming compositions results in a composition possessing improved thermal response and/or increased efficiency of thermal image formation.

The color-forming composition (or system) of the record material of this invention comprises chromogenic material in its substantially colorless state and acidic developer material such as, for example, phenolic compounds. The color-forming system relies upon melting or subliming of one or more of the components to achieve reactive, color-producing contact.

The record material includes a substrate or support material which is generally in sheet form. For purposes of this invention, sheets also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The gist of this invention resides in the color-forming composition coated on the substrate. The kind or type of substrate material is not critical.

The components of the color-forming system are in a contiguous relationship, substantially homogeneously distributed throughout the coated layer material deposited on the substrate. In manufacturing the record material, a coating composition is prepared which includes a fine dispersion of the components of the color-forming system, polymeric binder material, surface active agents and other additives in an aqueous coating medium. The composition can additionally contain inert pigments, such as clay, talc, aluminum hydroxide, calcined kaolin clay and calcium carbonate; synthetic pigments, such as urea-formaldehyde resin pigments; natural waxes such as Carnuba wax; synthetic waxes; lubricants such as zinc stearate; wetting agents and defoamers.

The color-forming system components are substantially insoluble in the dispersion vehicle (preferably water) and are ground to an individual average particle size of between about 1 micron to about 10 microns, preferably about 3 microns. The polymeric binder material is substantially vehicle soluble although latexes are also eligible in some instances. Preferred water-soluble binders include polyvinyl alcohol, hydroxy ethylcellulose, methylcellulose, hydroxypropylmethylcellulose, starch, modified starches, gelatin and the like. Eligible latex materials include polyacrylates, polyvinylacetates, polystyrene, and the like. The polymeric binder is used to protect the coated materials from brushing and handling forces occasioned by storage and use of the thermal sheets. Binder should be present in an amount to afford such protection and in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

Eligible chromogenic compounds, such as the phthalide, leucauramine and fluoran compounds, for use in the color-forming system are well known color-forming compounds. Examples of the compounds include Crystal Violet Lactone [3,3-bis(4-dimethylaminophenyl)-6-dimethylaminophthalide (U.S. Pat. No. Re. 23,024)]; phenyl-, indol-, pyrrol-, and carbazol-substituted phthalides (for example, in U.S. Pat. Nos. 3,491,111; 3,491,112; 3,491,116; 3,509,174); nitro-, amino-, amido-, sulfon amido-, amino-benzylidene-, halo-, anilino-substituted fluorans (for example, in U.S. Pat. Nos. 3,624,107; 3,627,787; 3,641,011; 3,642,828; 3,681,390); spirodipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are: 3-diethylamino-6-methyl-7-anilino-fluoran (U.S. Pat. No. 3,681,390); 7-(1-ethyl-2-methylindol-3-yl)-7-(4-diethylamino-2-ethoxyphenyl)-5,7-dihydrofuro[3,4-b]pyridin-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethylamino-2-ethoxyphenyl)-5,7-dihydrofuro[3,4-b]pyridin-5-one; 3-diethylamino-7,8-benzofluoran; 3,3-bis(1-ethyl-2-methylindol-3-yl)phthalide; 3-diethylamino-7-anilinofluoran; 3-diethylamino-7-benzylaminofluoran; 3'-phenyl-7-dibenzylamino-2,2'-spiro-di[2H-1-benzopyran]; and mixtures of any two or more of the above.

Examples of eligible acidic developer material include the compounds listed in U.S. Pat. No. 3,539,375 as phenolic reactive material, particularly the monophenols and diphenols. Eligible acidic developer material also includes, without being considered as limiting, the following compounds which may be used individually or in mixtures: 4,4'-isopropylidinediphenol (Bisphenol A); p-hydroxybenzaldehyde; p-hydroxybenzophenone; p-hydroxypropiophenone; 2,4-dihydroxybenzophenone; 1,1-bis(4-hydroxy-3-methylphenyl)cyclohexane; 1,1-bis(4-hydroxyphenyl)cyclohexane; 4-hydroxy-2-methyl-acetophenone; 2-acetylbenzoic acid; 2,4-dihydroxyacetophenone; 4-hydroxy-4'-methylbenzophenone; 4,4'-dihydroxybenzophenone; 2,2-bis(4-hydroxyphenyl)-4-methylpentane; benzyl 4-hydroxyphenyl ketone; 2,2-bis(4-hydroxyphenyl)-5-methyl-hexane; ethyl-4,4-bis(4-hydroxyphenyl)pentanoate; 3,3-bis(4-hydroxyphenyl)pentane; 4,4-bis(4-hydroxyphenyl)heptane; 2,2-bis(4-hydroxyphenyl)-1-phenylpropane; 2,2-(bis(4-hydroxyphenyl)butane; 2,2'-methylene-bis(4-ethyl-6-tertiarybutyl phenol); 4-hydroxycoumarin; 7-hydroxy-4-methylcoumarin; 2,2'-methylene-bis(4-octyl phenol). Preferred among these are the phenolic developer compounds. More preferred among the phenol compounds are 4,4'-isopropylidenediphenol; 2,2-bis(4-hydroxyphenyl)-4-methylpentane; ethyl-4,4-bis(4-hydroxyphenyl)pentanoate; isopropyl-4,4-bis(4-hydroxyphenyl)pentanoate; methyl-4,4-bis(4-hydroxyphenyl)pentanoate; 4,4'-thiobis(6-tert.butyl-m-cresol); 1,1-bis(4-hydroxyphenyl)cyclohexane; 4,4'-sulfonyldiphenol and mixtures thereof. Acid compounds of other kinds and types are eligible. Examples of such other compounds are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, hallosyte, and the like. Some of the polymers and minerals do not melt but undergo color reaction on fusion of the chromogen.

The following examples are given to illustrate some of the features of the present invention and should not be considered as limiting. In these examples all parts are by weight and all measurements are in the metric system, unless otherwise stated.

In all examples illustrating the present invention a dispersion of a particular system component was prepared by milling the component in an aqueous solution of the binder until a particle size of between about 1 micron and 10 microns was achieved. The milling was accomplished in an attritor or other suitable dispersing device. The desired average particle size was about 3 microns in each dispersion.

In these examples separate dispersions comprising the chromogenic compound (Component A), the acidic developer material (Component B) and the hydroxyanilide compounds (Component C) were prepared.

| Material | Parts |
|---|---|
| Component A | |
| Chromogenic compound | 13.60 |
| Binder, 10% polyvinyl alcohol in water | 24.00 |
| Water | 42.35 |
| Defoamer & dispersing agent* | 0.05 |
| Component B | |
| Acidic developer material | 13.60 |
| Binder, 10% polyvinyl alcohol in water | 24.00 |
| Water | 42.35 |
| Defoamer & dispersing agent* | 0.05 |
| Component C | |
| Hydroxyanilide compound | 13.60 |
| Binder, 10% polyvinyl alcohol in water | 24.00 |
| Water | 42.35 |

-continued

| Material | Parts |
|---|---|
| Defoamer & dispersing agent* | 0.05 |

*Equal parts of the defoamer Nopko NDW (sulfonated caster oil produced by a Nopko Chemical Company) and the dispersing agent Surfynol 104 (a di-tertiary acetylene glycol surface active agent produced by Air Products and Chemicals Inc.) were employed.

The chromogenic compounds employed in the examples are listed in Table 1.

TABLE 1

| Chromogenic Compound | Designation of Dispersion Comprising said Chromogenic Compound |
|---|---|
| 3-diethylamino-6-methyl-7-anilinofluoran | A-1 |
| 3,3-bis(4-dimethylaminophenyl)-6-dimethylamino-phthalide | A-2 |
| 7-(1-ethyl-2-methylindol-3-yl)-7-(4-diethylamino-2-ethoxyphenyl)-5,7-dihydrofuro[3,4-b]pyridin-5-one | A-3 |

The acidic developer materials employed in the examples are listed in Table 2.

TABLE 2

| Acidic Developer Compound | Designation of Dispersion Comprising said Developer Compound |
|---|---|
| 4,4'-isopropylidinediphenol (Bisphenol A) | B-1 |
| 2,2-bis(4-hydroxyphenyl)-4-methylpentane | B-2 |
| ethyl-4,4-bis(4-hydroxyphenyl)pentanoate | B-3 |
| isopropyl-4,4-bis(4-hydroxyphenyl)pentanoate | B-4 |
| methyl-4,4-bis(4-hydroxyphenyl)pentanoate | B-5 |
| 4,4'-thiobis(6-tert.butyl-m-cresol) | B-6 |
| 4,4'-butylidene(6-tert.butyl-m-cresol) | B-7 |
| 1,1-bis(4-hydroxyphenyl)cyclohexane | B-8 |
| 4,4'-sulfonyldiphenol | B-9 |

The hydroxyanilide compounds employed in the examples are listed in Table 3.

TABLE 3

| Compound | Designation of Dispersion Comprising said Compound |
|---|---|
| p-hydroxyacetanilide | C-1 |
| p-hydroxybutyranilide | C-2 |
| p-hydroxynonananilide | C-3 |
| p-hydroxylauranilide | C-4 |
| p-hydroxyoctadecananilide | C-5 |

In addition another dispersion comprising p-hydroxyoctadecananilide was prepared as follows:

| Dispersion C-5-A | |
|---|---|
| Material | Parts |
| p-hydroxyoctadecananilide | 9.2 |
| Binder, 10% solution of polyvinyl alcohol in water | 33.0 |
| water | 57.74 |
| defoamer and dispersing agent* | 0.06 |

*See formulation for Component C hereinabove

Mixtures of dispersions A and B (controls), mixtures of dispersions A and C (controls) and mixtures of dispersions A, B and C (examples of the invention) were made. In some cases one or more of the following materials was added to the resulting mixture:

1. A 68% kaolin clay slurry in water (designated hereinbelow as "clay")
2. A 10% solution of polyvinyl alcohol in water (designated hereinbelow as "PVA")
3. Water In Table 4 are listed each of these mixtures, including the components added and the parts by weight of each.

TABLE 4

| Example | Components | Parts |
|---|---|---|
| 1-1 | Dispersion A-1 | 1.0 |
| | Dispersion B-1 | 2.5 |
| | Dispersion C-1 | 2.5 |
| | Clay | 1.8 |
| | PVA | 3.0 |
| | Water | 2.5 |
| 1-2 | Dispersion A-1 | 1.0 |
| | Dispersion B-1 | 2.5 |
| | Dispersion C-2 | 2.5 |
| | Clay | 1.8 |
| | PVA | 2.8 |
| | Water | 2.5 |
| 1-3 | Dispersion A-1 | 1.0 |
| | Dispersion B-1 | 2.5 |
| | Dispersion C-3 | 2.5 |
| | Clay | 1.8 |
| | PVA | 2.8 |
| | Water | 2.5 |
| 1-4 | Dispersion A-1 | 1.0 |
| | Dispersion B-1 | 2.5 |
| | Dispersion C-4 | 2.5 |
| | Clay | 1.8 |
| | PVA | 2.8 |
| | Water | 2.5 |
| 1-5 | Dispersion A-1 | 1.0 |
| | Dispersion B-1 | 2.5 |
| | Dispersion C-5 | 1.8 |
| | Clay | 1.8 |
| | PVA | 2.8 |
| | Water | 2.5 |
| Control 1 | Dispersion A-1 | 1.0 |
| | Dispersion B-1 | 4.9 |
| | Clay | 1.8 |
| | PVA | 3.0 |
| | Water | 2.5 |
| 2 | Dispersion A-1 | 1.0 |
| | Dispersion B-2 | 2.5 |
| | Dispersion C-5 | 2.5 |
| | Clay | 1.8 |
| | PVA | 3.0 |
| | Water | 2.5 |
| Control 2 | Dispersion A-1 | 1.0 |
| | Dispersion B-2 | 4.9 |
| | Clay | 1.8 |
| | PVA | 3.0 |
| | Water | 2.5 |
| 3 | Dispersion A-1 | 1.0 |
| | Dispersion B-3 | 3.4 |
| | Dispersion C-5-A | 6.3 |
| | Clay | 1.3 |
| | PVA | 2.0 |
| Control 3 | Dispersion A-1 | 1.0 |
| | Dispersion B-3 | 6.7 |
| | Clay | 1.4 |
| | PVA | 2.9 |
| | Water | 1.8 |
| 4 | Dispersion A-1 | 1.0 |
| | Dispersion B-4 | 3.5 |
| | Dispersion C-5-A | 6.3 |
| | Clay | 1.3 |
| | PVA | 1.9 |
| Control 4 | Dispersion A-1 | 1.0 |
| | Dispersion B-4 | 7.0 |
| | Clay | 1.3 |
| | PVA | 2.8 |
| | Water | 1.7 |
| 5 | Dispersion A-1 | 1.0 |
| | Dispersion B-5 | 4.4 |
| | Dispersion C-3 | 4.4 |
| | Clay | 1.3 |
| | PVA | 3.1 |

TABLE 4-continued

| Example | Components | Parts |
|---|---|---|
| Control 5 | Dispersion A-1 | 1.0 |
| | Dispersion B-5 | 6.4 |
| | Clay | 1.3 |
| | PVA | 3.1 |
| | Water | 1.4 |
| 6 | Dispersion A-2 | 1.0 |
| | Dispersion B-5 | 3.2 |
| | Dispersion C-3 | 3.2 |
| | Clay | 1.3 |
| | PVA | 3.1 |
| | Water | 1.4 |
| Control 6 | Dispersion A-2 | 1.0 |
| | Dispersion B-5 | 6.4 |
| | Clay | 1.3 |
| | PVA | 3.1 |
| | Water | 1.4 |
| 7 | Dispersion A-3 | 1.0 |
| | Dispersion B-5 | 3.2 |
| | Dispersion C-3 | 3.2 |
| | Clay | 1.3 |
| | PVA | 3.1 |
| | Water | 1.4 |
| Control 7 | Dispersion A-3 | 1.0 |
| | Dispersion B-5 | 6.4 |
| | Clay | 1.3 |
| | PVA | 3.1 |
| | Water | 1.4 |
| 8 | Dispersion A-1 | 1.0 |
| | Dispersion B-6 | 2.5 |
| | Dispersion C-5-A | 4.5 |
| | Clay | 1.8 |
| | PVA | 3.0 |
| | Water | 2.3 |
| Control 8 | Dispersion A-1 | 1.0 |
| | Dispersion B-6 | 4.9 |
| | Clay | 1.8 |
| | PVA | 3.0 |
| | Water | 2.5 |
| 9 | Dispersion A-1 | 1.0 |
| | Dispersion B-7 | 2.5 |
| | Dispersion C-5-A | 4.5 |
| | Clay | 1.8 |
| | PVA | 3.0 |
| | Water | 2.3 |
| Control 9 | Dispersion A-1 | 1.0 |
| | Dispersion B-7 | 4.9 |
| | Clay | 1.8 |
| | PVA | 3.0 |
| | Water | 2.5 |
| 10 | Dispersion A-1 | 1.0 |
| | Dispersion B-8 | 2.5 |
| | Dispersion C-5-A | 4.5 |
| | Clay | 1.8 |
| | PVA | 3.0 |
| | Water | 1.2 |
| Control 10 | Dispersion A-1 | 1.0 |
| | Dispersion B-8 | 4.9 |
| | Clay | 1.8 |
| | PVA | 3.0 |
| | Water | 2.5 |
| 11 | Dispersion A-1 | 1.0 |

TABLE 4-continued

| Example | Components | Parts |
|---|---|---|
| | Dispersion B-9 | 2.5 |
| | Dispersion C-5-A | 4.5 |
| | Clay | 1.8 |
| | PVA | 1.2 |
| Control 11 | Dispersion A-1 | 1.0 |
| | Dispersion B-9 | 4.9 |
| | Clay | 1.8 |
| | PVA | 3.0 |
| | Water | 2.5 |
| Control 1-1 | Dispersion A-1 | 1.0 |
| | Dispersion C-1 | 4.9 |
| | Clay | 1.8 |
| | PVA | 3.0 |
| | Water | 2.5 |
| Control 1-2 | Dispersion A-1 | 1.0 |
| | Dispersion C-2 | 4.9 |
| | Clay | 1.8 |
| | PVA | 2.8 |
| | Water | 2.5 |
| Control 1-3 | Dispersion A-1 | 1.0 |
| | Dispersion C-3 | 4.9 |
| | Clay | 1.8 |
| | PVA | 2.8 |
| | Water | 2.5 |
| Control 1-4 | Dispersion A-1 | 1.0 |
| | Dispersion C-4 | 4.9 |
| | Clay | 1.8 |
| | PVA | 2.8 |
| | Water | 2.5 |
| Control 1-5 | Dispersion A-1 | 1.0 |
| | Dispersion C-5 | 4.9 |
| | Clay | 1.8 |
| | PVA | 2.8 |
| | Water | 2.5 |
| Control 6-1 | Dispersion A-2 | 1.0 |
| | Dispersion C-3 | 6.4 |
| | Clay | 1.4 |
| | PVA | 3.4 |
| | Water | 1.7 |
| Control 7-1 | Dispersion A-3 | 1.0 |
| | Dispersion C-3 | 6.4 |
| | Clay | 1.4 |
| | PVA | 3.4 |
| | Water | 1.7 |

Each of the mixtures of Table 4 was applied to paper at a weight of about 5.2 to about 5.9 gsm dry coat weight.

Each of the thermally-sensitive record material sheets coated with one of the mixtures of Table 4 was imaged by contacting the coated sheet with a metallic imaging block at the indicated temperature for 5 seconds. The intensity of each image was measured by means of a reflectance reading using a Bausch & Lomb Opacimeter. A reading of 100 indicates no discernable image and a low value indicates good image development. The intensity of the image of each Example is presented in Table 5.

TABLE 5

| | Reflectance Intensity of Image Developed at Indicated Fahrenheit Temperature | | | | | | | | | | |
|---|---|---|---|---|---|---|---|---|---|---|---|
| Example | 300° | 275° | 260° | 245° | 230° | 215° | 200° | 185° | 170° | 155° | 140° |
| 1-1 | 7.9 | 12.1 | 15.9 | 25.5 | 47.4 | 70.4 | 91.0 | 100.0 | 100.0 | 100.0 | 100.0 |
| 1-2 | 7.8 | 12.5 | 17.3 | 28.9 | 48.5 | 58.8 | 90.4 | 100.0 | 100.0 | 100.0 | 100.0 |
| 1-3 | 7.0 | 7.4 | 8.3 | 9.7 | 14.0 | 30.8 | 93.0 | 100.0 | 100.0 | 100.0 | 100.0 |
| 1-4 | 7.5 | 8.4 | 9.6 | 15.7 | 44.6 | 94.8 | 100.0 | 100.0 | 100.0 | 100.0 | 100.0 |
| 1-5 | 7.8 | 10.2 | 13.4 | 29.2 | 80.3 | 94.0 | 100.0 | 100.0 | 100.0 | 100.0 | 100.0 |
| Control 1 | 6.6 | 15.5 | 42.8 | 70.3 | 92.6 | 100.0 | 100.0 | 100.0 | 100.0 | 100.0 | 100.0 |
| 2 | 7.7 | 8.8 | 9.6 | 22.1 | 85.1 | 100.0 | 100.0 | 100.0 | 100.0 | 100.0 | 100.0 |
| Control 2 | 8.5 | 21.5 | 77.0 | 90.6 | 100.0 | 100.0 | 100.0 | 100.0 | 100.0 | 100.0 | 100.0 |
| 3 | 6.4 | 6.1 | 6.7 | 7.8 | 29.1 | 85.2 | 100.0 | 100.0 | 100.0 | 100.0 | 100.0 |
| Control 3 | 5.6 | 6.0 | 6.5 | 8.9 | 46.8 | 84.4 | 100.0 | 100.0 | 100.0 | 100.0 | 100.0 |
| 4 | 5.6 | 5.8 | 6.1 | 7.2 | 13.5 | 75.0 | 100.0 | 100.0 | 100.0 | 100.0 | 100.0 |
| Control 4 | 5.8 | 6.2 | 6.9 | 7.7 | 50.4 | 90.0 | 100.0 | 100.0 | 100.0 | 100.0 | 100.0 |
| 5 | 6.3 | 6.6 | 7.3 | 8.2 | 10.3 | 24.8 | 94.5 | 100.0 | 100.0 | 100.0 | 100.0 |
| Control 5 | 7.6 | 10.4 | 31.4 | 81.0 | 100.0 | 100.0 | 100.0 | 100.0 | 100.0 | 100.0 | 100.0 |

TABLE 5-continued

| Example | Reflectance Intensity of Image Developed at Indicated Fahrenheit Temperature | | | | | | | | | | |
|---|---|---|---|---|---|---|---|---|---|---|---|
| | 300° | 275° | 260° | 245° | 230° | 215° | 200° | 185° | 170° | 155° | 140° |
| 6 | 13.2 | 12.8 | 12.7 | 12.6 | 13.4 | 17.9 | 65.6 | 100.0 | 100.0 | 100.0 | 100.0 |
| Control 6 | 9.2 | 9.3 | 13.8 | 25.0 | 67.5 | 100.0 | 100.0 | 100.0 | 100.0 | 100.0 | 100.0 |
| 7 | 6.4 | 6.7 | 7.0 | 7.7 | 9.8 | 15.1 | 80.1 | 100.0 | 100.0 | 100.0 | 100.0 |
| Control 7 | 6.0 | 6.2 | 8.7 | 19.8 | 57.3 | 93.1 | 100.0 | 100.0 | 100.0 | 100.0 | 100.0 |
| 8 | 6.9 | 7.2 | 8.1 | 14.0 | 46.1 | 77.5 | 92.0 | 100.0 | 100.0 | 100.0 | 100.0 |
| Control 8 | 12.3 | 21.2 | 37.5 | 49.6 | 65.6 | 81.7 | 92.7 | 100.0 | 100.0 | 100.0 | 100.0 |
| 9 | 20.6 | 26.2 | 54.5 | 86.3 | 100.0 | 100.0 | 100.0 | 100.0 | 100.0 | 100.0 | 100.0 |
| Control 9 | 96.6 | 100.0 | 100.0 | 100.0 | 100.0 | 100.0 | 100.0 | 100.0 | 100.0 | 100.0 | 100.0 |
| 10 | 8.1 | 10.4 | 15.8 | 62.4 | 94.8 | 100.0 | 100.0 | 100.0 | 100.0 | 100.0 | 100.0 |
| Control 10 | 34.2 | 77.8 | 100.0 | 100.0 | 100.0 | 100.0 | 100.0 | 100.0 | 100.0 | 100.0 | 100.0 |
| 11 | 12.4 | 15.2 | 46.5 | 85.3 | 100.0 | 100.0 | 100.0 | 100.0 | 100.0 | 100.0 | 100.0 |
| Control 11 | 58.9 | 76.8 | 83.1 | 87.8 | 93.7 | 100.0 | 100.0 | 100.0 | 100.0 | 100.0 | 100.0 |
| Control 1-1 | 89.3 | 96.6 | 100.0 | 100.0 | 100.0 | 100.0 | 100.0 | 100.0 | 100.0 | 100.0 | 100.0 |
| Control 1-2 | 20.1 | 41.1 | 75.8 | 93.1 | 100.0 | 100.0 | 100.0 | 100.0 | 100.0 | 100.0 | 100.0 |
| Control 1-3 | 7.8 | 8.7 | 10.0 | 16.5 | 88.4 | 100.0 | 100.0 | 100.0 | 100.0 | 100.0 | 100.0 |
| Control 1-4 | 23.6 | 50.4 | 86.4 | 100.0 | 100.0 | 100.0 | 100.0 | 100.0 | 100.0 | 100.0 | 100.0 |
| Control 1-5 | 75.8 | 76.9 | 100.0 | 100.0 | 100.0 | 100.0 | 100.0 | 100.0 | 100.0 | 100.0 | 100.0 |
| Control 6-1 | 61.3 | 67.2 | 71.2 | 77.2 | 90.6 | 100.0 | 100.0 | 100.0 | 100.0 | 100.0 | 100.0 |
| Control 7-1 | 11.9 | 12.9 | 17.3 | 27.8 | 90.4 | 100.0 | 100.0 | 100.0 | 100.0 | 100.0 | 100.0 |

From the data of Table 5 it is readily apparent that thermally-responsive recording materials comprising a hydroxyanilide compound possess improved thermal response and/or enhanced image intensity compared to corresponding thermally-responsive recording material in which the hydroxyanilide compound is omitted.

When thermally-sensitive record material sheets were prepared utilizing p-ethoxyacetanilide in place of the hydroxyanilides of the present invention, the resulting thermal image developed an objectionable and commercially unacceptable image bloom. The thermal images of the present invention did not develop an image bloom.

The invention being thus described, it will be obvious that the same may be varied in many ways. Such variations are not to be regarded as a departure from the spirit and scope of the invention, and all such modifications are intended to be included within the scope of the following claims.

What is claimed:

1. A thermally-responsive record material comprising a support member bearing a thermally-sensitive color-forming composition comprising chromogenic material and acidic developer material in contiguous relationship, whereby the melting or sublimation of either material produces a change in color by reaction between the two, one or more hydroxyanilide compounds represented by the formula:

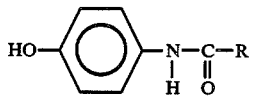

wherein R represents a straight or branched alkyl group of not more than 17 carbon atoms;
and a suitable binder therefor.

2. The record material of claim 1 in which the hydroxyanilide compound is selected from the group consisting of p-hydroxyacetanilide; p-hydroxybutyranilide; p-hydroxynonananilide; p-hydroxylauranilide; and p-hydroxyoctadecananilide.

3. The record material of claim 2 in which the hydroxyanilide compound is p-hydroxynonananilide or p-hydroxylauranilide.

4. The record material of claim 1 in which the acidic developer material is a phenol compound.

5. The record material of claim 4 in which the phenol compound is selected from the group consisting of 4,4'-isopropylidinediphenol, 2,2-bis(4-hydroxyphenyl)-4-methylpentane; ethyl-4,4-bis(4-hydroxyphenyl)pentanoate; isopropyl-4,4-bis(4-hydroxyphenyl)pentanoate; methyl-4,4-bis(4-hydroxyphenyl)pentanoate; and mixtures thereof.

6. The record material of claim 5 in which the phenol compound is 4,4'-isopropylidenediphenol or 2,2-bis(4-hydroxyphenyl)-4-methylpentane.

7. The record material of claim 1 in which the chromogenic material is selected from the group consisting of 3-diethylamino-6-methyl-7-anilinofluoran; 7-(1-ethyl-2-methylindol-3-yl)-7-(4-diethylamino-2-ethoxyphenyl)-5,7-dihydrofuro[3,4-b]pyridin-5-one; 3-diethylamino-7-(2-chloroanilino)fluoran; 3-(N-methylcyclohexylamino)-6-methyl-7-anilinofluoran; 7-(1-octyl-2-methylindol-3-yl)-7-(4-diethylamino-2-ethoxyphenyl)-5,7-dihydrofuro[3,4-b]pyridin-5-one; 3'-phenyl-7-dibenzylamino-2,2'-spiro-di-[2H-1-benzopyran]; 3,3-bis(4-dimethylaminophenyl)-6-dimethylaminophthalide and mixtures thereof.

8. The record material of claim 7 in which the chromogenic material is 3-diethylamino-6-methyl-7-anilinofluoran.

9. The record material of claim 1, 3, 6 or 8 in which the binder is selected from the group consisting of polyvinyl alcohol, methylcellulose, hydroxypropylmethylcellulose, starch, hydroxyethylcellulose and mixtures thereof.

10. The record material of claim 9 in which the binder is selected from the group consisting of polyvinyl alcohol, methylcellulose, starch and mixtures thereof.

11. The record material of claim 10 in which the binder is a mixture of polyvinyl alcohol, methylcellulose and starch.

* * * * *